US006397493B1

(12) United States Patent
Halmschlager et al.

(10) Patent No.: US 6,397,493 B1
(45) Date of Patent: Jun. 4, 2002

(54) MACHINE FOR PRODUCING AND/OR TREATING A MATERIAL WEB

(75) Inventors: Günter Halmschlager, Krems; Walter Holzer, Hofstetten; Manfred Gloser; Peter Haslinger, both of St. Pölten, all of (AT)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/643,967

(22) Filed: Aug. 23, 2000

(30) Foreign Application Priority Data

Aug. 31, 1999 (DE) ..... 199 41 334

(51) Int. Cl.[7] ..... F26B 13/10

(52) U.S. Cl. ..... 34/454; 34/311; 34/417; 34/444; 34/94; 34/611; 34/624; 34/634; 34/242; 34/116

(58) Field of Search ..... 34/309, 311, 417, 34/418, 419, 420, 421, 422, 443, 444, 94, 611, 618, 620, 624, 639, 635, 292, 114, 115, 116, 117, 122, 123, 454

(56) References Cited

U.S. PATENT DOCUMENTS

| | | | | | |
|---|---|---|---|---|---|
| 2,835,048 | A | * | 5/1958 | Olthius et al. | 34/242 |
| 2,919,495 | A | * | 1/1960 | Underhay et al. | 34/114 |
| 3,040,702 | A | * | 6/1962 | Eng et al. | 118/49 |
| 3,048,992 | A | * | 8/1962 | Naguchi | 34/242 |
| 3,058,232 | A | * | 10/1962 | Farkass | 34/242 |
| 3,303,576 | A | * | 2/1967 | Sisson | 34/116 |
| 3,919,783 | A | * | 11/1975 | Cirrito | 34/23 |
| 4,124,942 | A | * | 11/1978 | Ohls et al. | 34/115 |
| 4,214,758 | A | * | 7/1980 | Gorodissky et al. | 277/12 |
| 4,461,095 | A | | 7/1984 | Lehtinen | |
| 5,115,581 | A | * | 5/1992 | Viitanen | 34/115 |
| 5,152,076 | A | * | 10/1992 | Virta et al. | 34/16 |
| 5,787,603 | A | * | 8/1998 | Steiner et al. | 34/117 |
| 6,189,233 | B1 | | 2/2001 | Halmschlager et al. | |

FOREIGN PATENT DOCUMENTS

| | | |
|---|---|---|
| DE | 19607476 | 4/1997 |
| DE | 19723163 | 12/1998 |

* cited by examiner

*Primary Examiner*—Ira S. Lazarus
*Assistant Examiner*—K. B. Rinehart
(74) *Attorney, Agent, or Firm*—Greenblum & Bernstein, P.L.C.

(57) ABSTRACT

An apparatus for at least one of producing and treating a material web is provided including at least one wire; an outer sealing belt, which is wider than said at least one wire, comprising a pair of lateral edge regions; at least one heatable unit, having an outer cylindrical surface, wherein said at least one wire and said outer sealing belt are at least partially wrapped around said at least one heatable unit; an overpressure cap arranged to form a pressure chamber containing a medium under pressure, said medium under pressure exerting a pressure on said at least one heatable unit; and at least one of: (a) a seal formed between said lateral edge regions and said heatable unit; and (b) a seal formed between end faces of said overpressure cap and an opposing wall to seal said pressure chamber from an external environment.

30 Claims, 4 Drawing Sheets

MACHINE FOR PRODUCING AND/OR TREATING A MATERIAL WEB

CROSS-REFERENCE TO RELATED APPLICATIONS

The present application claims priority under 35 U.S.C. §119 of German Patent Application No. 199 41 334.7, filed on Aug. 31, 1999, the disclosure of which is expressly incorporated by reference herein in its entirety.

BACKGROUND OF THE INVENTION

1 . Field of the Invention

The invention relates to a machine for producing and/or treating a material web, in particular a paper or cardboard web, having at least one heatable unit, such as in particular a pressing roll, a drying cylinder, and/or the like, which is wrapped around part of its outer cylindrical surface by the material web and at least one wire and an outer sealing belt, and having an overpressure cap that subjects the heatable unit to a liquid or gaseous medium under pressure.

2. Discussion of Background Information

It is known to dry material webs on cylinders, between two steel belts (U.S. Pat. No. 4,461,095) or between a heated cylinder and a steel belt or sealing belt (DE 197 23 163 A1). A drying section of the type mentioned initially is described in DE 197 23 163 A1.

While no sealing is necessary in the case of drying on one cylinder, it is necessary in the case of drying between a heated cylinder and an externally cooled steel belt or sealing belt to prevent the cooling medium from entering the dry space between the steel belt or sealing belt. Specifically, a steam pressure should arise between the heated cylinder and the paper that drives the as yet unvaporized water from the paper to the cooled side of the paper in the wires. Also in the case of drying between two steel belts, the space in which the paper and the wires are located, and also the space for the cooling and heating medium, must be sealed. Here, sealing of the paper space is usually accomplished by a lateral thickening of the wires in the form of a sealing bead. The space for the cooling and heating medium is closed off by costly seals such as, in particular, flat surfaces with high speeds relative to the steel belts traveling along with the paper web.

SUMMARY OF THE INVENTION

The present invention provides a machine of the type initially mentioned in which, in the simplest possible manner, the region occupied by the material web and the at least one wire or felt is reliably sealed with respect to the pressure chamber of the overpressure cap, on the one hand, and this pressure chamber is reliably sealed with respect to the outside, on the other hand.

The invention includes a sealing belt that is wider than the material web and the wire, such that both of its lateral edge regions extend past them. Further, both of its edge regions are pressed so as to seal against the surface of the heatable unit by the overpressure prevailing in the pressure chamber of the overpressure cap. Additionally, or alternatively, the pressure chamber of the overpressure cap can be sealed with respect to the outside at each of its two end faces by a seal that is located between an end wall of the stationary overpressure cap and an opposing wall, in particular a radial, cylinder-side opposing wall.

On the basis of this design, an extremely reliable seal of the region occupied by the material web and the at least one wire, and/or of the pressure chamber of the overpressure cap, is achieved with minimal cost in a simple manner. An underpressure can be created or maintained with the relevant seal of the region occupied by the material web and the wire, which results in an increase in drying performance. Moreover, entry of the liquid or gaseous medium is prevented. Because of the appropriate sealing of the pressure chamber of the overpressure cap, a structural pressure can be applied which results not only in greater drying performance, but also in improved paper characteristics.

The liquid or gaseous medium under pressure can be, in particular, a cooling medium. As a result of the fact that the temperature of the liquid or gaseous medium is lower than the temperature at the outer side of the part of the outer cylindrical surface of the heatable element wrapped by the material web and the wire, a high degree of liquid removal from the material web can be achieved. One or more wires can be provided, where it is possible in such a case that a wire located further outside has a coarser structure than a wire located further inside. In the case of several wires, they can be separate from one another or they can be connected together at least partially. The sealing belt can be separate, or connected to at least one wire belt.

At least one cylinder-side opposing wall is preferably located in the vicinity of an end of the heatable element.

In one useful practical embodiment, the material web and the wire are arranged in a recess provided on the outer cylindrical surface of the heatable unit with the sealing belt being wider than this recess and both of the lateral edge regions of the belt extending beyond it. The depth of the recess can be at least essentially the same as the overall height of the material web and wire.

It is also advantageous for the opposing edges or side walls of the recess to be coated with a material that is heat resistant, flexible, and seals well, for example such as Teflon, silicone, or the like. In this way, sealing the space between the heatable unit and the material web is significantly improved, and the steam pressure produced in this space during drying is increased. Accordingly, the quantity of water expelled from the material web is also increased, and the drying performance is improved for the same heat output.

For an even more reliable seal of the region occupied by the material web and the wire, it is useful to provide at least one sealing pocket or chamber opposite each lateral edge region of the sealing belt and covered thereby. It is advantageous for at least one sealing pocket or chamber to be located opposite each of the two lateral edge regions of the sealing belt. In certain cases, it can be useful for at least two sealing pockets or chambers to be located opposite at least one of the two edge regions of the sealing belt.

In a preferred embodiment, at least one sealing pocket or chamber is provided that is connected to the surroundings and accordingly is under ambient or atmospheric pressure. As a result of the defined pressure difference between the relevant sealing chamber and the pressure chamber of the overpressure cap, sufficient contact force on the sealing surface can be ensured. If coolant fluid enters a sealing pocket or chamber as a result of a failure, this fluid is carried away by the relevant connecting channel(s), bore(s), or passageway(s), which can serve as an indicator of leakage.

More usefully, the at least one cylinder-side opposing wall can be formed by a disk arranged at the relevant end of the heatable unit. In this context, the sealing force can be applied, for example, by the preloading of the overpressure cap as a result of the internal pressure, or it can be applied mechanically. When the sealing force is generated by the internal pressure, the overpressure cap is pressed against the disk and the seal is automatically subjected to a preloading corresponding to the pressure. When the internal pressure changes, the preloading of the seal adjusts automatically.

In another advantageous embodiment, at least one cylinder-side opposing wall is formed by a shoulder provided in the vicinity of each bearing journal of the heatable unit, and the relevant end face of the overpressure cap is extended to the region of this bearing journal. For example, the seal can be located in the vicinity of the bearing journal or at some point in the middle. In this case as well, the sealing force can again be applied by the preloading of the cap as a result of the internal pressure, or mechanically. As a result of the fact that the relevant opposing wall and the seal are located in the vicinity of the bearing journal, the relative speed between the rotating and the stationary part is lower, which reduces wear on the seal accordingly.

It is advantageous for at least one end face of the heatable unit to be provided with a heat-resistant material, which reduces to a minimum the direct flow of heat between the heatable unit and the cold coolant.

In certain cases, it is useful for at least one seal located between an end face of the stationary overpressure cap and a cylinder-side opposing wall to be acted upon by a resilient element arranged between the end face and the opposing wall. In particular, this may be a mechanical element with at least one spring, for example.

Of course, the pressure chamber of the overpressure cap can also be sealed with respect to the outside by at least one non-contacting seal, such as a labyrinth seal or the like.

The heatable unit can, for example, also be provided as a shoe-press replacement with a very long nip.

According to an aspect of the present invention an apparatus for at least one of producing and treating a material web is provided having at least one wire; an outer sealing belt, which is wider than the at least one wire, comprising a pair of lateral edge regions; at least one heatable unit, having an outer cylindrical surface, wherein the at least one wire and the outer sealing belt are at least partially wrapped around the at least one heatable unit; an overpressure cap arranged to form a pressure chamber containing a medium under pressure, the medium under pressure exerting a pressure on the at least one heatable unit; and at least one of: (a) a seal formed between the lateral edge regions and the heatable unit; and (b) a seal formed between end faces of the overpressure cap and an opposing wall to seal the pressure chamber from an external environment.

According to another aspect of the present invention, the at least one heatable unit includes at least one of a pressing roll and a drying cylinder. Additionally, other aspects of the present invention includes an opposing wall which is a radially extending opposing wall.

In another aspect of the present invention, the opposing wall includes an axial end face of the at least one heatable unit. According to a further aspect of the present invention the opposing wall radially extends from a bearing journal. In another aspect of the present invention the opposing wall radially extends from an axial end region of said at least one heatable unit.

According to still a further aspect of the present invention the at least one heatable unit includes a recessed area having a width less than a width of the sealing belt. Further aspects of the invention include wherein the lateral edge regions of the sealing belt are arranged axially outside of the recessed area. According to other aspects of the present invention the at least one wire is positioned within said recess.

According to another aspect of the present invention, the material web includes at least one of paper and cardboard web. According to a further aspect of the present invention the depth of the recess is at least approximately the same as the overall height of the material web and wire. According to a still further aspect of the invention, the recess is defined by two opposing edge walls on the outer cylindrical surface of the at least one heatable unit.

According to an aspect of the present invention, the opposing edge walls of the recess are coated with a material that is heat resistant, flexible, and a sealant. According to another aspect of the present invention, the material is one of TEFLON and silicone.

Additionally, other aspects of the present invention include at least one sealing pocket or chamber provided on the outer cylindrical surface of the at least one heatable unit, and located opposite each lateral edge region of the sealing belt and covered thereby.

In another aspect of the present invention, at least two sealing pockets or chambers are provided on the outer cylindrical surface of the at least one heatable unit, and located opposite at least one of the two lateral edge regions of the sealing belt. According to a further aspect of the present invention, at least one sealing pocket or chamber is provided that is connected, by at least one of a channel, bore, and passageway, to ambient or atmospheric pressure.

In another aspect of the present invention, at least one end face of the at least one heatable unit is provided with a heat-resistant material. According to a further aspect of the present invention, the pressure chamber is sealed with respect to the outside by at least one non-contacting seal.

In another aspect of the present invention, at least one heatable unit is provided as a shoe-press replacement. According to a still further aspect of the present invention, the at least one wire includes a plurality of wires wherein a wire located further outside has a coarser structure than a wire located further inside. Further aspects of the invention include a resilient element that is positioned between the opposing wall and end face of said overpressure cap, wherein the seal is acted upon by the resilient element.

According to other aspects of the invention, the resilient element includes a mechanical element with at least one spring. According to another aspect of the invention, the opposing wall is a radial cylinder-side opposing wall attached to an end of the at least one heatable unit. According to a further aspect of the present invention at least one cylinder-side opposing wall is formed by a disk arranged at an end of the at least one heatable unit.

According to another aspect of the invention, the at least one seal is located between an end face of the cap and a cylinder-side opposing wall, and is acted upon by a resilient element arranged between the end face and the opposing wall. Additionally, other aspects pf the present invention include wherein the resilient element includes a mechanical element with at least one spring.

In another aspect of the invention, a process for producing and treating a material web, is provided including partially wrapping a material web around at least one heatable unit using at least one wire; pressurizing, with a medium, a pressure chamber positioned around at least a portion of the at least one heatable unit, whereby the medium exerts pressure on the at least heatable unit; sealing the material web and at least one wire between the at least one heatable unit and an outer sealing belt; and rotating the at least one heatable unit to process the material web.

According to a further aspect of the invention, a heat transfer effect occurs from the at least heatable unit toward the sealing belt. According to a still further aspect of the present invention, the process further includes relieving a pressure, buildup between the sealing belt and the at least one heatable unit to an external atmosphere using at least one of a channel, bore, and passageway.

In another aspect of the present invention, the process further includes removing a fluid buildup between the sealing belt and the at least one heatable unit to an external atmosphere using at least one of a channel, bore, and passageway. Further aspects of the invention includes wherein the pressurized medium exerts pressure on lateral edge portions of the outer sealing belt against the at least one heatable unit.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

Figure 1:
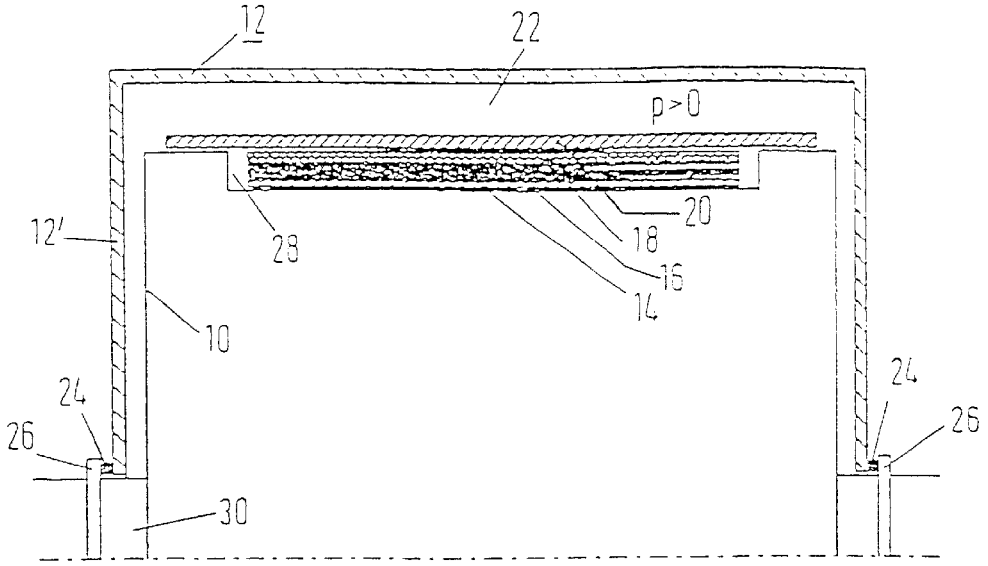
FIG. 1 is a schematic, partially sectioned view of a first embodiment of a drying cylinder with associated overpressure cap, in which the overpressure cap is sealed against shoulders provided in the vicinity of bearing journals of the drying cylinder.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

FIGS. 1 through 9 each show a heatable, rotating drying cylinder 10 with an associated, stationary overpressure cap 12 of a drying section of a machine for producing and/or treating of a material web 14. More specifically, the material web 14 can be a paper or cardboard web.

The material web 14 wraps around part of the outer cylindrical surface of the drying cylinder 10, as does at least one wire, in the present case two wires 16, 18, and an outer sealing belt 20. As can be seen in FIGS. 1 through 9, the two wires 16, 18 in the present case are between the material web 14 contacting the drying cylinder and the outer sealing belt 20. The wire 16 adjacent to the material web 14 can have a finer structure than the wire 18 adjacent to the sealing belt 20.

The heatable, rotating drying cylinder 10 is subjected by the stationery overpressure cap 12 to a liquid or gaseous medium under pressure, which, in particular, can be a coolant, so that a temperature drop occurs from the drying cylinder 10 toward the sealing belt 20. Of course, such an embodiment is also conceivable in which a pressure drop is generated in the other direction and the material web is in contact with the outer belt accordingly. In the pressure chamber 22 of the overpressure cap 12 containing the liquid or gaseous medium, a pressure p prevails that is greater than the ambient pressure or atmospheric pressure.

It can also be seen in FIGS. 1 through 9 that the sealing belt 20 is wider than the material web 14 and the two wires 16, 18, and both of its lateral edge regions extend beyond them. Accordingly, the two edge regions of the sealing belt 20 are pressed against the surface of the drying cylinder 10, so as to seal, by the overpressure p prevailing in the pressure chamber 22 of the overpressure cap. The region occupied by the material web 14 and the two wires 16, 18 is thus sealed by the sealing belt 20, which is impermeable to liquid and/or gas.

The pressure chamber 22 of the overpressure cap 12 is sealed with respect to the outside at each of its two opposing end faces by a seal 24 that is located between the relevant end wall 12' of the stationary overpressure cap 12 and an opposing wall 26, in particular a cylinder-side, radial opposing wall, in the vicinity of the relevant drying cylinder end.

In the embodiments shown in FIGS. 1 through 5 and 7 through 9, the material web 14 and the wires 16, 18 are located in a recess 28 provided on the outer cylindrical surface of the drying cylinder 10. The sealing belt 20 is wider than this recess 28 and both of the lateral edge regions of the belt extend beyond it. It must be rigid enough that it is not drawn into the recess, causing interference.

The depth of the recess 28 is preferably at least approximately the same as the overall height of the material web 14 and the wires 16, 18.

The recess 28 accommodating the material web 14 and the wires 16, 18 is accordingly sealed relative to the pressure chamber 22 of the overpressure cap 12 by the sealing belt whose edges are pressed against the drying cylinder 10.

As can be seen especially well in FIGS. 1 through 5, 7, and 8, the material web 14 and the wires 16, 18 have a certain axial freedom of movement in the recess 28. This can be approximately 20 mm, for example.

Figure 2:
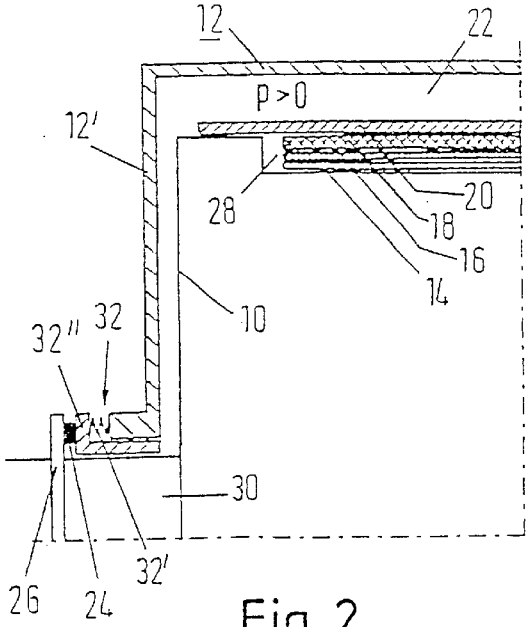
FIG. 2 is a schematic, partially sectioned partial view of another embodiment, whose essential difference from that of FIG. 1 is that the seals are acted upon by additional resilient elements.
Figure 3:
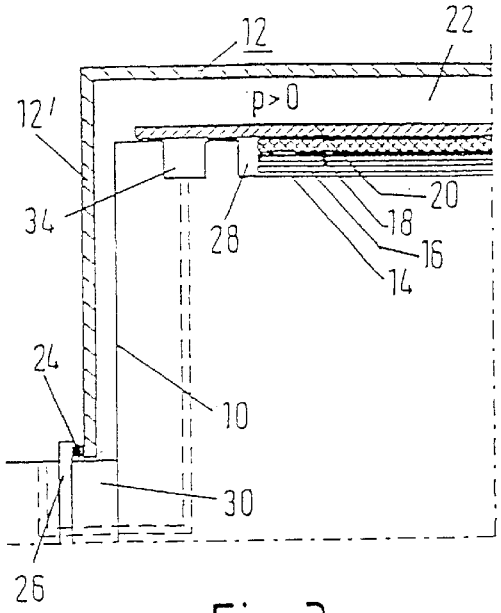
FIG. 3 is a schematic, partially sectioned partial view of another embodiment, whose essential difference from that of FIG. 1 is that one sealing pocket or chamber is provided on each of the two sides of the recess provided in the drying cylinder.

In the embodiments shown in FIGS. 1 through 3, the two cylinder-side opposing walls 26 are each formed by a shoulder provided in the vicinity of each bearing journal 30 of the drying cylinder 10. The end walls 12' of the overpressure cap 12 are extended to the region of the bearing journals 30. The seals 24 are located in the vicinity of the relevant bearing journal 30 between the relevant end face 12' and the shoulder in question.

In these embodiments shown in FIGS. 1 through 3, the pressure chamber 22 of the overpressure chamber is extended laterally to each of the bearing journals 30. As a result of the overpressure in the pressure chamber 22 of the overpressure cap 12, the end walls 12' can thus be pressed against the cylinder-side opposing walls 26 or shoulders, causing the seals 24 to be subjected to a preloading corresponding to this pressure. When the internal pressure changes, the preloading of the seals 24 adjusts automatically.

Figure 4:
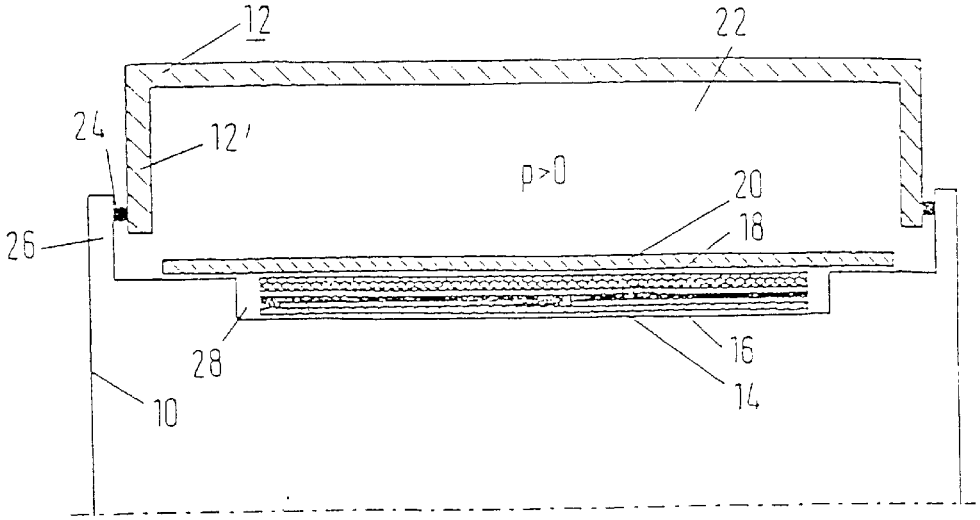
FIG. 4 is a schematic, partially sectioned view of another embodiment, whose essential difference from that of FIG. 1 is that the overpressure cap is sealed against disks located on the drying cylinder ends.
Figure 5:
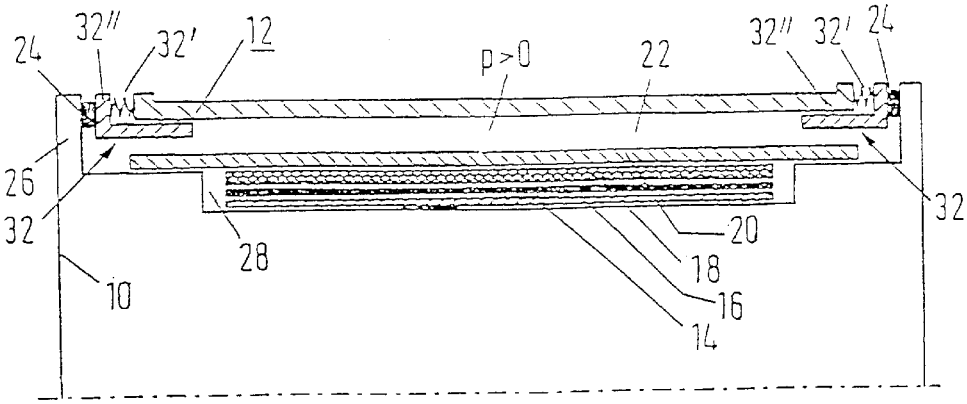
FIG. 5 is a schematic, partially sectioned view of another embodiment, whose essential difference from that of FIG. 4 is that the seals are acted upon by additional resilient elements.

As can be seen especially well in FIGS. 2 and 4, the seals 24 located between a particular end wall 12' of the stationary overpressure cap 12 and a particular cylinder-side opposing wall 26 can also be acted upon by an element 32, in particular a mechanical, resilient element 32 with, for example, at least one spring 32', also located between the end wall 12' and the opposing wall 26. As can be seen in FIGS. 2 and 5, the particular spring 32' can act on the relevant seal 24 by an axially movable stop 32". The resilient elements 32 are attached in non-rotary fashion to the overpressure cap 12, i.e., they do not rotate with the drying cylinder 10. The seals 24 are thus located between a rotating and a non-rotating part.

Figure 7:
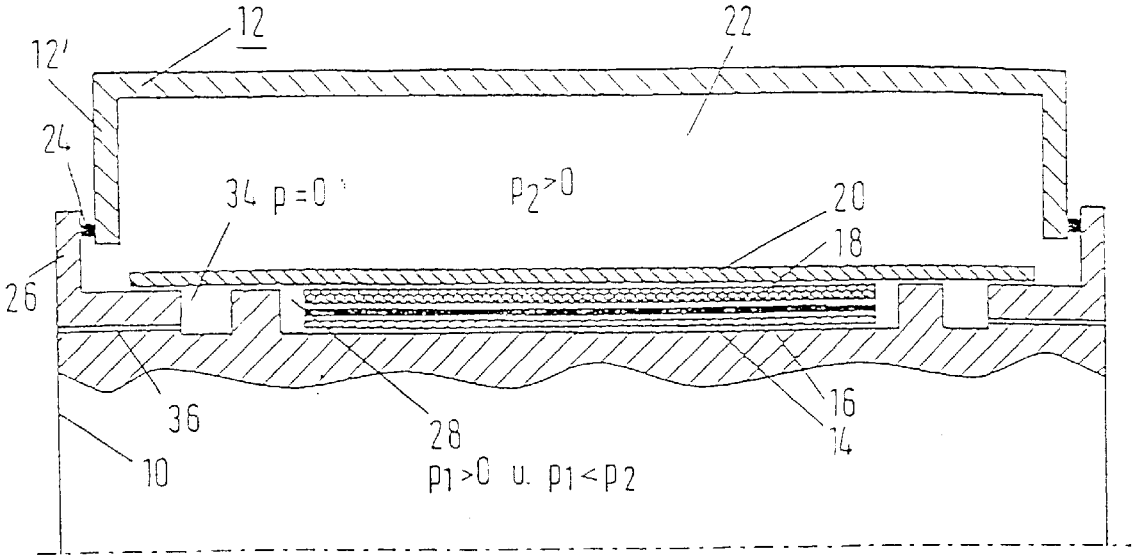
FIG. 7 is a schematic, partially sectioned view of another embodiment, whose essential difference from that of FIG. 4 is that one sealing pocket or chamber is provided on each of the two sides of the recess provided in the drying cylinder.

In the embodiments shown in FIGS. 3 and 7, one sealing pocket or chamber 34 is provided opposite each respective lateral edge region of the sealing belt 20 on the outer circumference of the drying cylinder 10 on both sides of the recess 28. These sealing pockets or chambers 34 are also covered by the lateral edge regions of the sealing belt 20.

The two sealing pockets or chambers 34 are each connected to the surroundings by at least one channel 36 or at least one bore so that they are under ambient or atmospheric pressure. The defined pressure difference between the pressure chamber 22 of the overpressure cap 12 and the sealing pockets or chambers 34 ensures that the two edge regions of the sealing belt 20 are pressed against the drying cylinder 10 with sufficient force.

Figure 8:
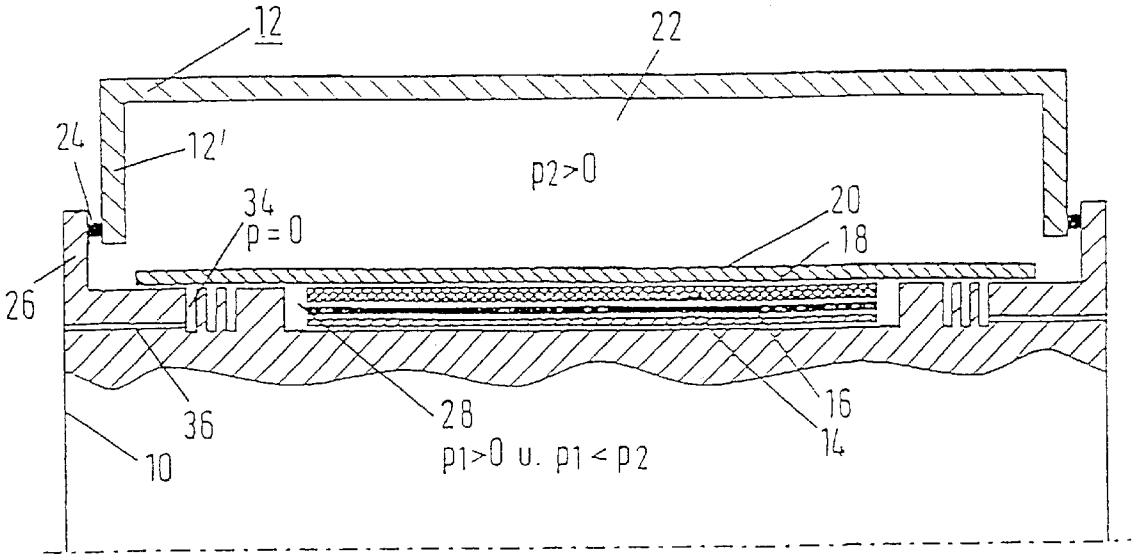
FIG. 8 is a schematic, partially sectioned view of another embodiment, whose essential difference from that of FIG. 7 is that several sealing pockets or chambers are provided on each of the two sides of the recess provided in the drying cylinder.

As can be seen in FIG. 8, several sealing pockets or chambers 34 can also be provided on each of the two sides of the recess 28. In the present case, three such sealing pockets or chambers 34 are provided on each side of the recess 28. Of these three sealing pockets or chambers 34, the axially outermost one in each case is connected to the surroundings by at least one channel (or passageway) 36.

In the embodiments in FIGS. 4 through 9, the two cylinder-side, opposing radial walls 26 are each formed by a disk located at the relevant drying cylinder end.

As can be seen especially well in FIGS. 7 and 8, the pressure $p_1$ in the recess 28, while greater than the ambient or atmospheric pressure, is less than the pressure $P_2$ in the pressure chamber 22 of the overpressure cap 12.

Especially in the embodiments shown in FIGS. 1 through 3, in which the pressure chamber 22 of the overpressure cap 12 is extended laterally to the bearing journals 30, the end faces of the drying cylinder 10 can be provided with a heat-resistant material.

Figure 6:
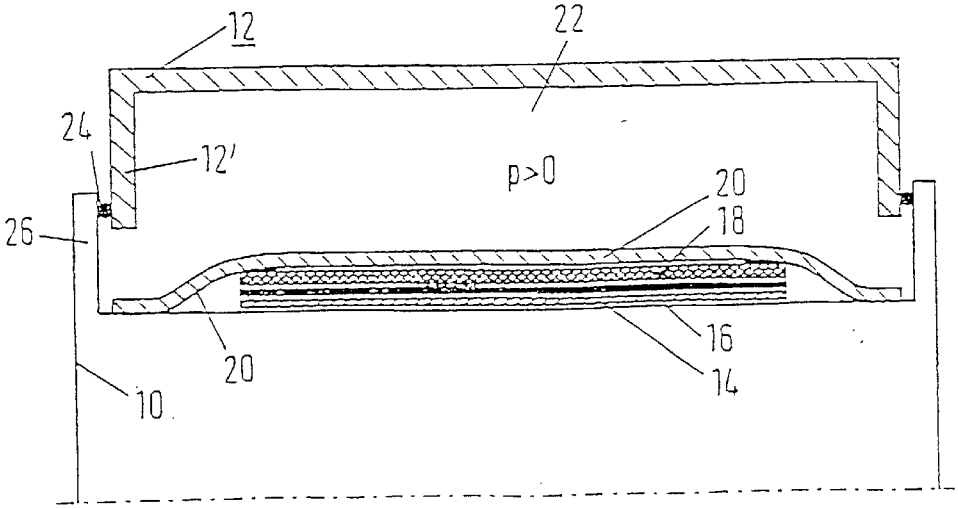
FIG. 6 is a schematic, partially sectioned view of another embodiment, whose essential difference from that of FIG. 4 is that the material web and the wire are passed over a drying cylinder that is smooth in the relevant area, with no recess.

As can be seen in FIG. 6, the material web 14, the wires 16, 18 and the sealing belt 20 can also be passed over a drying cylinder 10 that is smooth in the relevant area, with no recess. In this case as well, the region occupied by the material web 14 and the wires 16, 18 is sealed relative to the pressure chamber 22 of the overpressure cap 12 by the sealing belt 20 in that its protruding edge regions are pressed against the cylinder surface by the overpressure in the pressure chamber 22.

Figure 9:
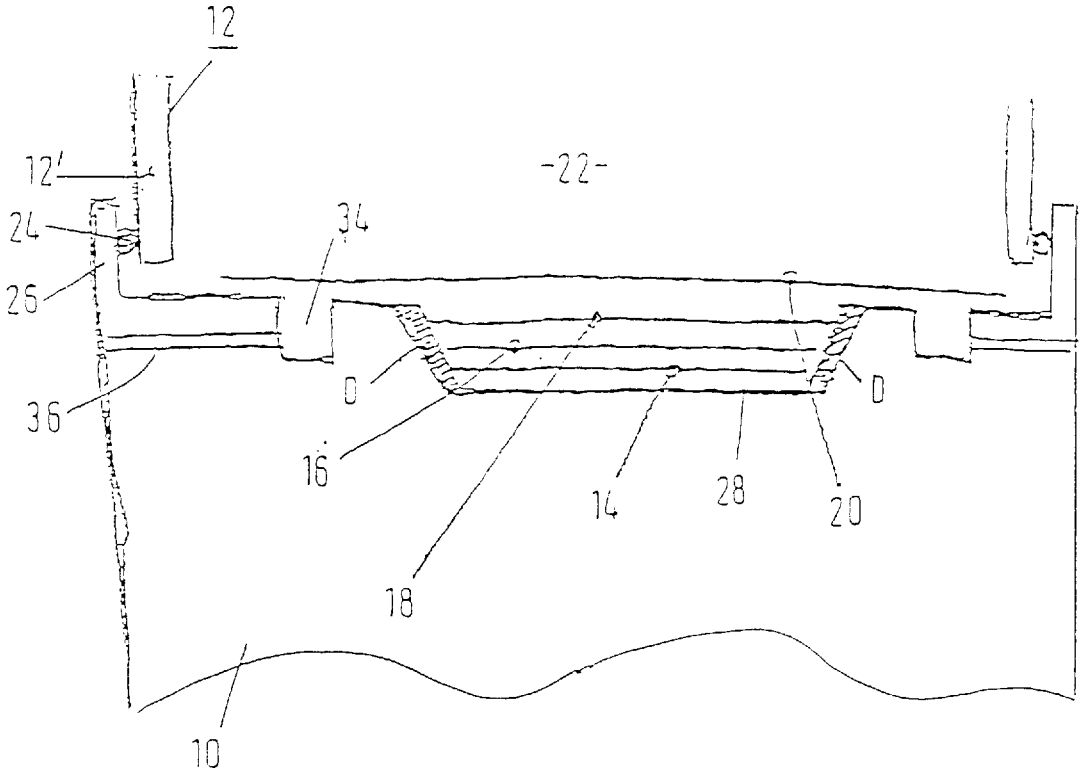
FIG. 9 is a schematic, partially sectioned view of another embodiment, whose essential difference from that of FIG. 7 is that the edges of the recess are coated by a material that is heat resistant, flexible and seals well.

In the embodiment in FIG. 9, the edges or side walls of the recess 28 are coated with a material D that is heat resistant, flexible, and seals well, especially such as Teflon (polytetrafluoroethylene), silicone, or the like.

Of course, the pressure chamber 22 of the overpressure cap 12 can, for example, also be sealed with respect to the outside by at least one non-contacting seal, such as, in particular, a labyrinth seal or the like.

Moreover, the drying cylinder can also be coated with a corresponding material that is heat resistant and seals well. The same also applies to the sealing belt. If several sealing pockets or chambers are provided, a reliable seal is ensured even when coolant fluid has entered the axially outermost sealing pocket or chamber as a result of a failure. The fluid that has entered the first chamber is carried away by the relevant channel or channels, which can serve as an indicator of leakage. The seal of the space between the hot cylinder and the material web can be significantly improved by coating the recess. Moreover, the steam pressure produced in this space during drying is increased. Accordingly, a greater quantity of water is expelled from the material web, and the drying performance is improved for the same heat output. If the pressure chamber is sealed in the vicinity of the bearing journals, the relative speed between the rotating and stationary parts is lower, which reduces wear on the seals accordingly.

Of course, any desired combinations of the features shown in the various figures are possible as well.

Furthermore, the relevant drying section can also be implemented as is described in DE 197 23 163 A1, for example.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE CHARACTERS

10 heatable unit, drying cylinder
12 overpressure cap
12' end wall
14 material web
16 wire
18 wire
20 sealing wall
22 pressure chamber
24 seal

26 radial, cylinder-side opposing wall
28 recess
30 bearing journal
32 resilient element
32' spring
32" axially movable stop
34 sealing pocket or chamber
36 channel, bore
D sealing material

We claim:

1. An apparatus for at least one of producing and treating a material web, comprising:

at least one wire;

an outer sealing belt, which is wider than said at least one wire, comprising a pair of lateral edge regions;

at least one heatable unit, having an outer cylindrical surface, wherein said at least one wire and said outer sealing belt are at least partially wrapped around said at least one heatable unit;

an overpressure cap arranged to form a pressure chamber containing a medium under pressure, said medium under pressure exerting a pressure on said at least one heatable unit; and at least one of:

(a) a seal formed between said lateral edge regions and said heatable unit; and (b) a seal formed between end faces of said overpressure cap and an opposing wall to seal said pressure chamber from an external environment.

2. The apparatus according to claim 1, wherein said at least one heatable unit comprises at least one of a pressing roll and a drying cylinder.

3. The apparatus according to claim 1, wherein said opposing wall comprises a radially extending opposing wall.

4. The apparatus according to claim 1, wherein said opposing wall comprises an axial end face of said at least one heatable unit.

5. The apparatus according to claim 1, wherein said opposing wall radially extends from a bearing journal.

6. The apparatus according to claim 1, wherein said opposing wall radially extends from an axial end region of said at least one heatable unit.

7. The apparatus according to claim 1, wherein said at least one heatable unit comprises a recessed area having a width less than a width of said sealing belt.

8. The apparatus according to claim 7, wherein said lateral edge regions of said sealing belt are arranged axially outside of said recessed area.

9. The apparatus according to claim 7, wherein said at least one wire is positioned within said recess.

10. The apparatus according to claim 1, wherein the material web comprises at least one of paper and cardboard web.

11. The apparatus according to claim 7, wherein the depth of said recess is at least approximately the same as the overall height of the material web and wire.

12. The apparatus according to claim 7, wherein said recess is defined by two opposing edge walls on said outer cylindrical surface of said at least one heatable unit.

13. The apparatus according to claim 12, wherein said opposing edge walls of said recess are coated with a material that is heat resistant, flexible, and a sealant.

14. The apparatus according to claim 13, wherein said material is one of polytetrafluoroethylene and silicone.

15. The apparatus according to claim 1, wherein at least one sealing pocket or chamber is provided on said outer cylindrical surface of said at least one heatable unit, and located opposite each lateral edge region of said sealing belt and covered thereby.

16. The apparatus according to claim 1, wherein at least two sealing pockets or chambers are provided on said outer cylindrical surface of said at least one heatable unit, and located opposite at least one of said two lateral edge regions of the sealing belt.

17. The apparatus according to claim 15, wherein said at least one sealing pocket or chamber is provided that is connected, by at least one of a channel, bore, and passageway, to ambient or atmospheric pressure.

18. The apparatus according to claim 1, wherein at least one end face of said at least one heatable unit is provided with a heat-resistant material.

19. The apparatus according to claim 1, wherein the pressure chamber is sealed with respect to the outside by at least one non-contacting seal.

20. The apparatus according to claim 1, wherein said at least one heatable unit is provided as a shoe-press replacement.

21. The apparatus according to claim 1, wherein said at least one wire comprises a plurality of wires wherein a wire located further outside has a coarser structure than a wire located further inside.

22. The apparatus according to claim 1, wherein a resilient element is positioned between said opposing wall and end face of said overpressure cap, wherein said seal is acted upon by said resilient element.

23. The apparatus according to claim 22, wherein said resilient element comprises a mechanical element with at least one spring.

24. The apparatus according claim 1, wherein said opposing wall is a radial cylinder-side opposing wall attached to an end of said at least one heatable unit.

25. The apparatus according to claim 24, wherein at least one cylinder-side opposing wall is formed by a disk arranged at an end of said at least one heatable unit.

26. The. apparatus according to claim 24, wherein at least one seal is located between an end face of said cap and a cylinder-side opposing wall, and is acted upon by a resilient element arranged between said end face and said opposing wall.

27. The apparatus according to claim 26, wherein said resilient element comprises a mechanical element with at least one spring.

28. A process for producing and treating a material web, comprising:

partially wrapping a material web around at least one heatable unit using at least one wire;

pressurizing, with a medium, a pressure chamber positioned around at least a portion of the at least one heatable unit, whereby the medium exerts pressure on the at least one heatable unit;

sealing the material web and at least one wire between the at least one heatable unit and an outer sealing belt;

rotating the at least one heatable unit to process the material web; and relieving a pressure buildup between the sealing belt and the at least one heatable unit to an external atmosphere using at least one of a channel, bore, and passageway.

29. A process for producing and treating a material web, comprising:

partially wrapping a material web around at least one heatable unit using at least one wire;

pressurizing, with a medium, a pressure chamber positioned around at least a portion of the at least one heatable unit, whereby the medium exerts pressure on the at least one heatable unit;

sealing the material web and at least one wire between the at least one heatable unit and an outer sealing belt;

rotating the at least one heatable unit to process the material web; and removing a fluid buildup between the sealing belt and the at least one heatable unit to an external atmosphere using at least one of a channel, bore, and passageway.

30. A process for producing and treating a material web, comprising:

partially wrapping a material web around at least one heatable unit using at least one wire;

pressurizing, with a medium, a pressure chamber positioned around at least a portion of the at least one heatable unit, whereby the medium exerts pressure on the at least one heatable unit;

sealing the material web and at least one wire between the at least one heatable unit and an outer sealing belt; and rotating the at least one heatable unit to process the material web, wherein the pressurized medium exerts pressure on lateral edge portions of the outer sealing belt against the at least one heatable unit.

* * * * *